US010245489B2

(12) United States Patent
Kim

(10) Patent No.: US 10,245,489 B2
(45) Date of Patent: Apr. 2, 2019

(54) AUTOMATIC BATTING TEE APPARATUS

(71) Applicant: Moo Sung Kim, Daegu (KR)

(72) Inventor: Moo Sung Kim, Daegu (KR)

( * ) Notice: Subject to any disclaimer, the term of this patent is extended or adjusted under 35 U.S.C. 154(b) by 0 days.

(21) Appl. No.: 15/028,598

(22) PCT Filed: Feb. 16, 2016

(86) PCT No.: PCT/KR2016/001562
§ 371 (c)(1),
(2) Date: Apr. 11, 2016

(87) PCT Pub. No.: WO2016/137152
PCT Pub. Date: Sep. 1, 2016

(65) Prior Publication Data

US 2018/0193711 A1 Jul. 12, 2018

(30) Foreign Application Priority Data

Feb. 25, 2015 (KR) ..... 10-2015-0026441

(51) Int. Cl.
*A63B 69/00* (2006.01)
*A63B 69/40* (2006.01)
*A63B 47/00* (2006.01)

(52) U.S. Cl.
CPC ..... *A63B 69/0002* (2013.01); *A63B 47/00* (2013.01); *A63B 47/002* (2013.01);
(Continued)

(58) Field of Classification Search
CPC ..... A63B 47/002; A63B 69/0075; A63B 2069/0008
(Continued)

(56) References Cited

U.S. PATENT DOCUMENTS 292,043 A * 1/1884 Parmerlee ..... A63B 69/408 124/7
1,223,386 A * 4/1917 Handelan ..... A63B 47/025 473/436
(Continued)

FOREIGN PATENT DOCUMENTS

JP 06-254193 9/1994
JP 10-211308 8/1998
(Continued)

OTHER PUBLICATIONS

Italian Search Report and Written Opinion dated May 12, 2016 for corresponding International patent application No. PCT/KR2016/001562.

*Primary Examiner* — Mitra Aryanpour
(74) *Attorney, Agent, or Firm* — Abelman, Frayne & Schwab

(57) ABSTRACT

The present invention relates to an automatic batting tee apparatus that includes a ball storage unit for continuously feeding balls therein for batting; a lifting unit for putting the balls discharged from the ball storage unit onto an upper end of a tee rod for T-batting; and a feeding unit disposed between the ball storage unit and the lifting unit. The apparatus can smoothly and quickly feed balls, particularly, baseballs to the lifting unit with the tee rod, using the ball storage unit having a variable internal space and rotary equipment. The automatic batting tee apparatus according to an embodiment of the present invention allows for not only batting practice, but fielding practice by a cylinder unit.

17 Claims, 7 Drawing Sheets

(52) U.S. Cl.
CPC ..... *A63B 69/00* (2013.01); *A63B 69/0075* (2013.01); *A63B 69/40* (2013.01); *A63B 2069/0008* (2013.01)

(58) Field of Classification Search
USPC ..... 473/417, 415, 419, 420, 423–429, 454, 473/462, 131–137, 422, 446, 438, 134; 124/6, 16, 36, 45, 46
See application file for complete search history.

(56) References Cited

U.S. PATENT DOCUMENTS 1,777,976 A * 10/1930 Lacoste ..... A63B 69/408 124/16
1,952,113 A * 3/1934 Beckett ..... A63B 57/0006 473/137
2,711,726 A * 6/1955 Darrell ..... F41J 9/18 124/32
3,298,694 A * 1/1967 Turnau ..... A63B 57/0006 473/136
3,378,263 A * 4/1968 Turnau ..... A63B 57/0006 473/135
3,533,631 A * 10/1970 Hladek ..... A63B 57/0006 473/136
3,822,688 A * 7/1974 Mayne ..... A63B 69/0026 124/6
4,122,822 A * 10/1978 Scheiwiller ..... A63B 69/408 124/36
4,248,202 A * 2/1981 Jaworski ..... F41B 7/08 124/16
4,299,383 A * 11/1981 Yuasa ..... A63B 69/406 473/436
5,294,109 A * 3/1994 Meade ..... A63B 69/40 124/50
5,733,209 A * 3/1998 McIntyre, IV ..... A63B 69/409 473/422
6,416,429 B1 * 7/2002 Pecoraro ..... A63B 69/0002 473/417
6,684,872 B2 * 2/2004 Kao ..... A63B 47/002 124/56
7,549,415 B2 * 6/2009 Karellas ..... A63B 69/002 473/446
7,874,942 B2 * 1/2011 Auzoux ..... A63B 67/06 473/417
8,840,482 B2 * 9/2014 Choi ..... A63B 57/0006 473/132
2003/0221683 A1 * 12/2003 Kao ..... A63B 47/002 124/16

FOREIGN PATENT DOCUMENTS

| | | |
|---|---|---|
| JP | 2009-039290 | 2/2009 |
| KR | 20-1999-0038309 | 10/1999 |
| KR | 10-2012-0066269 | 6/2012 |
| KR | 10-1389157 | 5/2014 |

* cited by examiner

AUTOMATIC BATTING TEE APPARATUS

CROSS REFERENCE TO RELATED APPLICATIONS

This application is a national phase of PCT application No. PCT/KR2016/001562, filed Feb. 16, 2016, which claims priority to KR patent application No. 10-2015-0026441, filed Feb. 25, 2015, all of which are incorporated herein by reference thereto.

TECHNICAL FIELD

The present invention relates to an automatic batting tee apparatus and, more particularly, a batting tee apparatus for baseball.

BACKGROUND ART

As more people enjoy leisure, even common people form various sports clubs, and not only see sports, but play the sports in person, thereby cultivating mutual friendship and promoting their health. For example, amateur baseball teams, soccer teams, or basketball teams periodically or non-periodically meet on sports grounds, and play games or improve their performances through physical training or technical drill.

Batting practice is necessary for baseball among various sports. In general, batting practice is performed, for example, in a way that a technical coach throws a ball to a batter and the batter hits the ball.

However, this type of manual practice requires a person to throw balls, and particularly, has a danger of a safety accident. For example, when a ball hit by a batter goes to the thrower or a bat slips off the hands of a batter, it may cause a severe injury. When a person is hit by a hit ball on his/her head or eyes, he/she may surfer a concussion, may lose his/her eyesight, or may even die.

An automatic batting practice apparatus for automatically supplying balls to solve this inconvenience has been proposed. A "Batting practice apparatus" disclosed in Korean Patent Application Publication No. 10-2012-0066269 (Patent Document 1) includes a lifter on one cylinder vertically disposed and lifts balls supplied from the outside into a batting path using the lifter. A batter hits the ball on the lifter at the highest position.

However, the apparatus has a problem in that balls are not smoothly supplied, so supply of balls is frequently stopped. This is because balls interfere with each other due to friction while they are conveyed through a pipe-shaped passage. This becomes more severe when humidity is high.

Further, because a compressor is used for operating the cylinder, the apparatus makes a large noise in operation. The noise by the compressor interferes with communication with a coach, a person who is sensitive to noise may become stressed, and training efficiency may be deteriorated.

Documents of Related Art (Patent Document 1) Korean Patent Application Publication No. 10-2012-0066269.

DISCLOSURE

Technical Problem

The present invention has been made in an effort to solve the problems and an object of the present invention is to provide an apparatus that can easily supply balls in a hopper to a tee rod and allows a person to simply and conveniently perform batting practice.

Further, the present invention allows for not only batting practice, but fielding practice such as catching or fungo.

Technical Solution

In order to achieve the objects of the present invention, an embodiment of the present invention provides an automatic batting tee apparatus that includes: a ball storage unit for continuously feeding balls therein for batting; a lifting unit for putting the balls discharged in the ball storage unit onto an upper end of a tee rod for T-batting; and a feeding unit disposed between the ball storage unit and the lifting unit, in which the ball storage unit includes: a hollow tub; a bottom plate having one or more holes at a body and a guide extending downward at a portion of an edge, and closing a bottom of the tub; a plurality of ribs arranged with predetermined intervals around inner sides of the tub and spaced from the bottom plate; elastic members disposed between the tub and the ribs; a rotary plate formed in a pyramid shape with a polygonal bottom and rotatably disposed on the bottom plate; and a motor for operating the rotary plate.

The rotary plate may have one or more wings along an edge of the bottom.

The wings may be made of a soft material in the shape of a thin long bar.

The distance from a center of the rotary plate to the edge of the bottom may be longer than or the same as the distance from the center of the rotary plate to the guide.

The rotary plate may further have a rotary bar coaxially disposed on the rotary plate.

The rotary bar may have one or more arms radially protruding outward around the rotary bar.

The ball storage unit may further include a vacuum pump sucking dirt through the holes and a tray collecting dirt sucked by the vacuum pump.

The elastic members may be compression springs.

The tub may be formed in the shape of a polyprism.

The number of the ribs may be the same as the number of the sides of the tub.

The ribs may have dampers protruding radially at both sides of the ribs.

The dampers may be made of rubber.

The lifting unit may include: rails vertically extending; a belt disposed in parallel with the rails and turned by a motor; a carriage sliding on the rails when the belt is turned; and a tee rod vertically disposed on the carriage.

The tee rod may include: a support bar longitudinally extending; a seat disposed at an upper end of the support bar to receive the balls; a spring disposed between the upper end of the support bar and the seat; and a sensor on the support bar.

The feeding unit may include two wheels spaced from each other, a belt wound around the wheels to be turned, and a plurality of pins arranged with regular intervals on an outer side of the belt.

The automatic batting tee apparatus may further include a cylinder unit.

The cylinder unit may be disposed at the same height as a lowest position of the seat of the tee rod.

The features and advantages may be made clear from the following detailed description based on the following drawings.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention.

Advantageous Effects

According to the present invention, there is provided an automatic feeding line that can control storage, feeding, and hitting of balls by arranging a ball storage unit, a feeding unit, and a lifting unit in a line.

In particular, the apparatus includes a ball storage unit that allows balls for batting practice to be smoothly and quickly fed.

Further, according to the present invention, it is possible to easily control not only the height, but the downward movement speed of the tee rod by vertically moving the tee rod in a belt-driving type, so the lifespan of the apparatus is increased.

Further, according to the present invention, it is possible to perform not only batting practice, but also fielding practice.

BEST MODE

Figure 1:
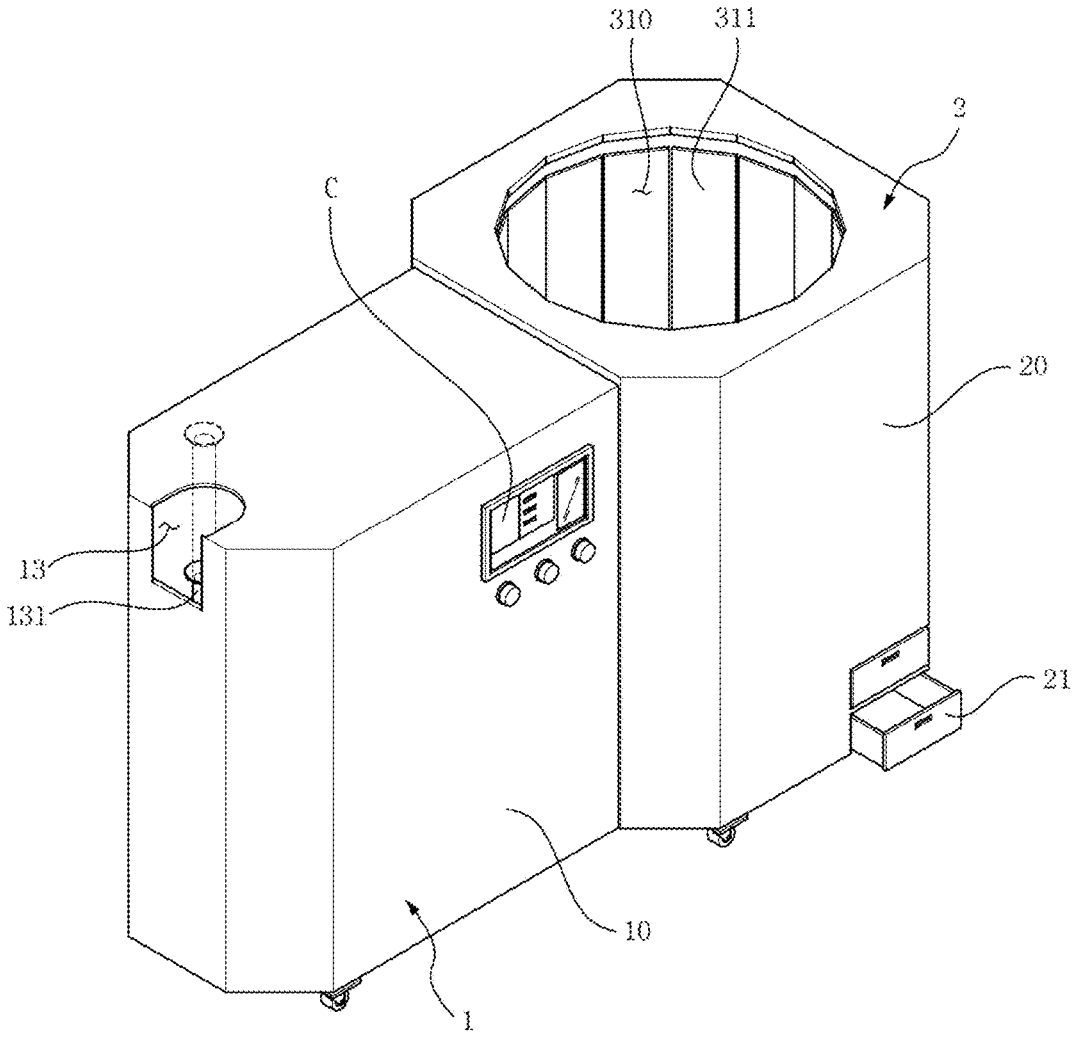
FIG. 1 is a perspective view of an automatic batting tee apparatus according to an embodiment of the present invention.
Figure 1A:
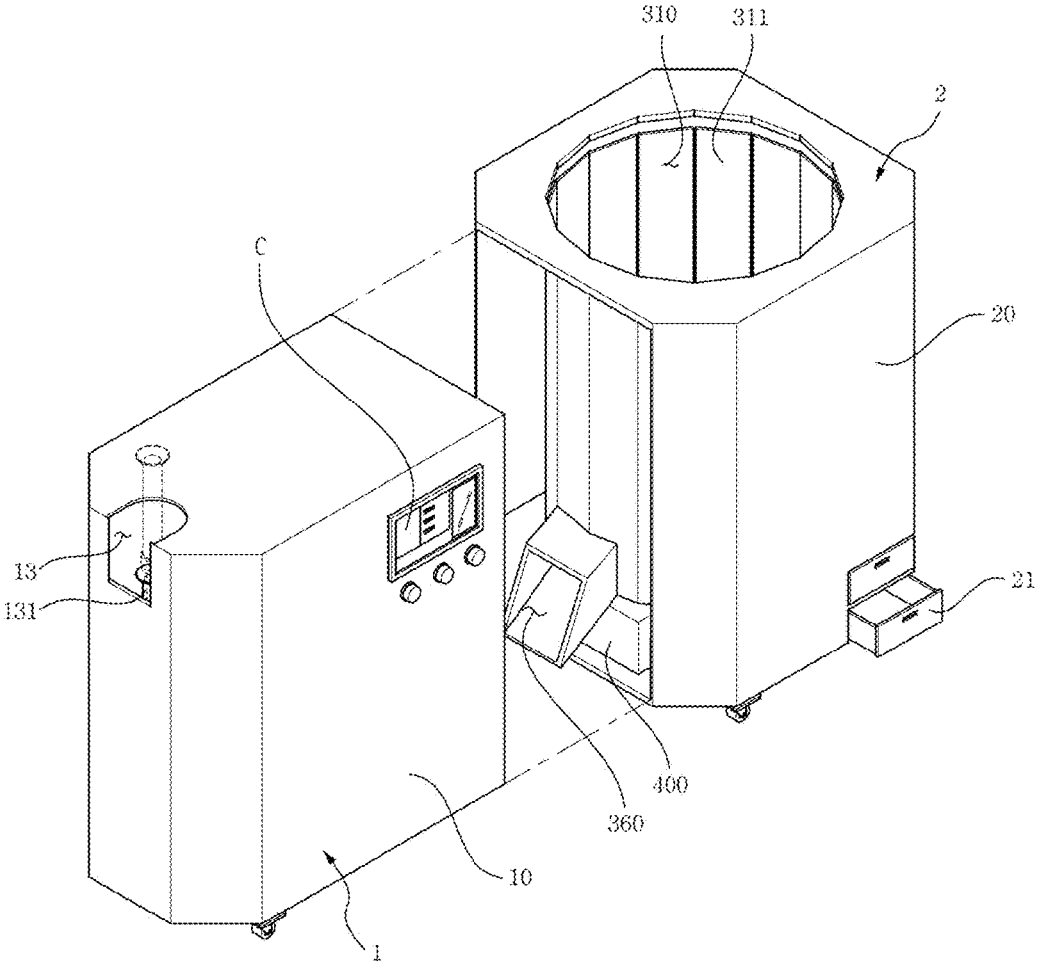
FIG. 1*a* is a perspective view before a first body and a second body are combined in the automatic batting tee apparatus according to an embodiment of the present invention.

An automatic batting tee apparatus according to the present invention is described hereafter in detail with reference to the accompanying drawings.

Advantages and features of the present invention and ways for achieving them will be clear through the embodiments to be described below with reference to the accompanying drawings. In the following description, like components shown in the drawings are given like or same reference numerals. Further, when it is determined that a detailed description of a well-known configuration may unnecessarily make the spirit of the present invention unclear, it is omitted.

Referring to FIGS. 1 to 4, an automatic batting tee apparatus according to an embodiment of the present invention is composed of a first body 1 including a lifting unit 100 for lifting balls B and a feeding unit 200 for conveying the balls B to a tee rod 131 of the lifting unit and a second body 2 including a ball storage unit 300 for temporarily keeping the balls B to be supplied to the feeding unit 200. The first body 1 and the second body 2 can be separated, so the present invention can provide convenience for carrying and/or assembling. The first body 1 and the second body 2 can be separably combined in various ways. Further, the first body 1 and the second body 2 have substantially the same level of height, so the lifting unit 100, the feeding unit 200, and the ball storage unit 300 can be arranged in a line in the automatic batting tee apparatus of the present invention.

Figure 3:
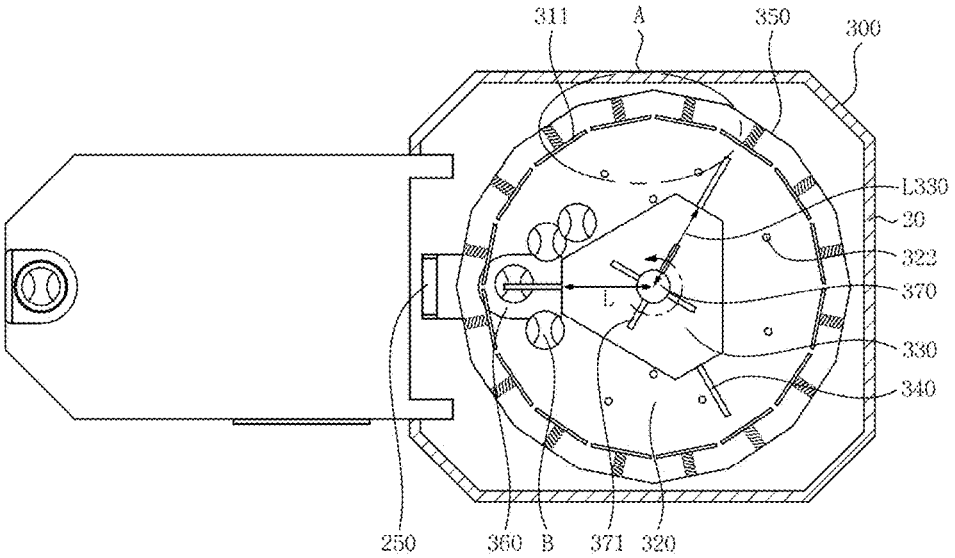
FIG. 3 is a plan view of the automatic batting tee apparatus with a top case of ball storage unit removed.
Figure 4:
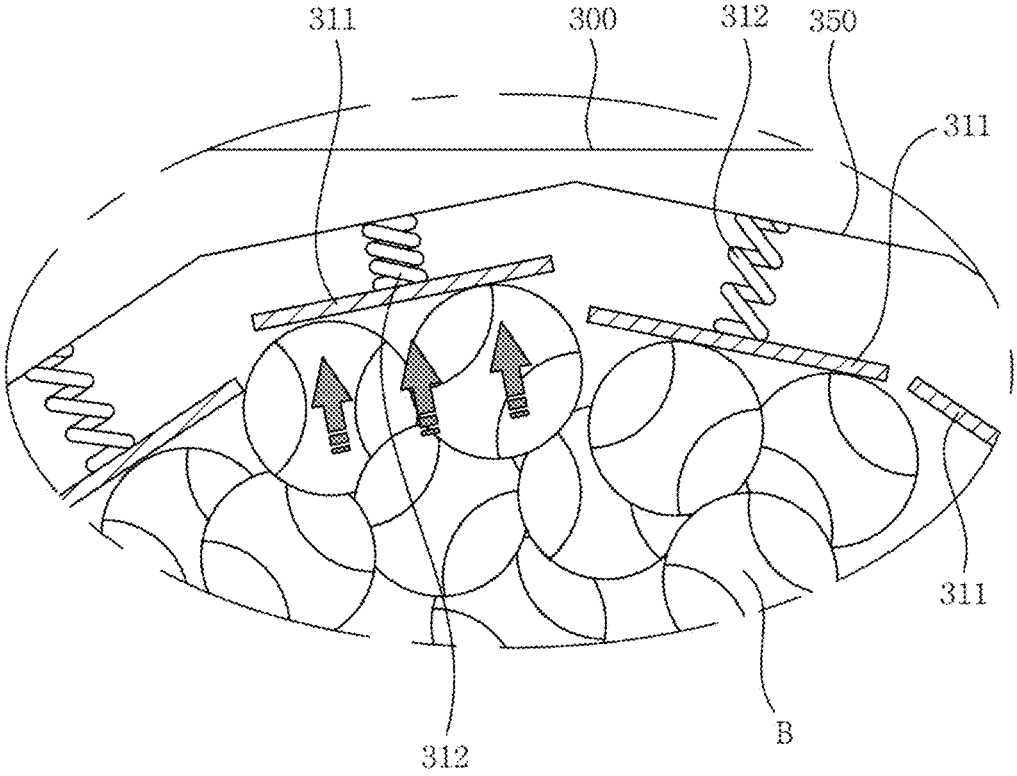
FIG. 4 is an enlarged cross-sectional view of the circle A in FIG. 3.

FIG. 3 is a plan view of the automatic batting tee apparatus with a top cover of the ball storage unit 300 removed, in which the internal configuration and arrangement state of the ball storage unit 300 can be seen. FIG. 4 is an enlarged view of a portion of FIG. 3.

The ball storage unit 300 is a part that allows balls B therein to be continuously fed to the feeding unit 200 (see FIG. 5) one by one. As shown in the figures, the ball storage unit 300 of the present invention includes a tub 350 with an open top and bottom, a bottom plate 320 covering the open bottom of the tub 350, and a rotary plate 330 rotatably disposed on the bottom plate 320.

The bottom plate 320 has a guide 360 at the outer circumference or at a portion of the edge and the guide 360 helps the balls B in the ball storage unit 300 be fed to the next part, that is, the feeding unit.

The rotary plate 330 is connected to a motor shaft and forcibly pushes the balls B to the guide 360 by rotating forward. When a ball B is pushed to the guide 360 by the rotary plate 330, the ball B can be dropped under the bottom plate 320 and fed to the feeding unit. When the balls B are not moved even by the forward rotation of the rotary plate 330, it is possible to spread the balls B jammed in the internal space 310 by rotating the rotary plate 300 backward, if needed.

The bottom of the rotary plate 330 overlaps the guide 360 as little as possible to make sure of discharging the balls B. That is, the distance $L_{330}$ from the center to the edge of the rotary plate 330 may be the same as the distance L from the center of the rotary plate 330 to the guide 360, as shown in the figures. However, it is not limited and the bottom of the rotary plate 330 may slightly overlap the guide 360.

As shown in the figures, the rotary plate 330 having a polygonal bottom has one or more wings 340 around the bottom. The wings 340 are arranged with regular intervals around the bottom of the rotary plate 300. The wings 340 are made of a soft material in the shape of a thin long bar and can guide even the outermost balls B on the rotary plate 320 to the guide 360 when the rotary plate 330 is rotated. The wings 340 may be made of silicon or rubber. When the wings 340 are made of rubber, they do not slip on the balls on the bottom plate 320, so they can easily carry the balls B in the rotational direction. Since the wings 340 are made of a soft material, when the balls B are jammed and not moved in the internal space 310, the wings 340 are bent when the rotary plate 330 is rotated, so damage to the wings 340 can be prevented.

Further, the rotary plate 330 has a rotary bar 370 coaxially disposed thereon. The rotary bar 370 has one or more arms 371 radially protruding on the outer side. The rotary bar 370 may be made of soft and flexible rubber not to damage the covers of the balls B when it comes in contact with the balls B.

The rotary bar 370 can spread balls B jammed with each other by applying a force (a rotational force) in a predetermined direction to the balls B close to the rotary bar 370 with the arms 371 so that the balls B can be moved while rotating with the rotary plate 330 among the balls B in the internal space 310. Alternatively, the rotary bar 370 may be axially moved up and down when the rotary plate 330 is rotated so that the balls B in the internal space can be vertically moved without moving in the rotational direction.

The automatic batting tee apparatus according to an embodiment of the present invention includes the polygonal hollow tub 350 fixed in a second case 20 where the ball storage unit 300 is disposed. The second case 20 is open at a portion of the top corresponding to the open top of the tub 350. Accordingly, balls B can be fed into the internal space 310 of the ball storage unit 300, so the balls B can be kept in the internal space 310 of the ball storage unit 300 limited by a plurality of ribs 311 and the bottom plate 320.

According to the automatic batting tee apparatus of the present invention, the tub 350 and the ribs 311 are arranged in a double pipe shape, in which the ribs 311 are coaxially arranged around and inside the tub 350. As shown in the figures, the ribs 311 are spaced at a predetermined distance from adjacent ribs. The gap between the ribs is supposed to the smaller than the diameter of balls. Further, the ribs 311 are held on the sides of the tub 350 by elastic members 312 to be spaced from the bottom plate 320 (see FIG. 4).

The tub 350 has a hollow polygonal shape, as shown in the figures, and the ribs 311 are arranged to face the sides of the tub 350, respectively. To this end, the numbers of the ribs 311 and the sides of the tub 350 are the same.

As described above, the ribs 311 are vertically disposed with a predetermined distance from the sides of the tub 350 and can be held on the sides in the tub 350 by the elastic members 312.

Balls B jammed in the internal space 310 are forcibly rotated by the rotary plate 330 and/or the rotary bar 370, that is, when an external force is applied, some of the balls B move horizontally toward the tub 350, that is, move radially while pressing the plate-shaped ribs 311. As the pressed ribs 311 are radially moved, the internal space 310 expands and vertical and/or horizontal gaps are generated among the balls B in the internal space 310, so the balls B can be fed down into the guide 360. Obviously, when the pressing force is removed, the ribs 211 can be returned by a restoring force of the elastic members 312.

The ribs 311 are flat plates, as shown in the figures, and have a shape corresponding to the sides of the tub 350. Alternatively, the ribs 311 may be curved concavely or convexly with a predetermined curvature.

The ball storage unit 300 having the variable internal space 310 can more effectively provide spare spaces among the balls B when the rotary plate 330 and/or the rotary bar 370 is rotated.

The ribs 311 can be held on the tub 350 by the elastic members 312. The elastic members 312 may be compression springs.

Figure 5:
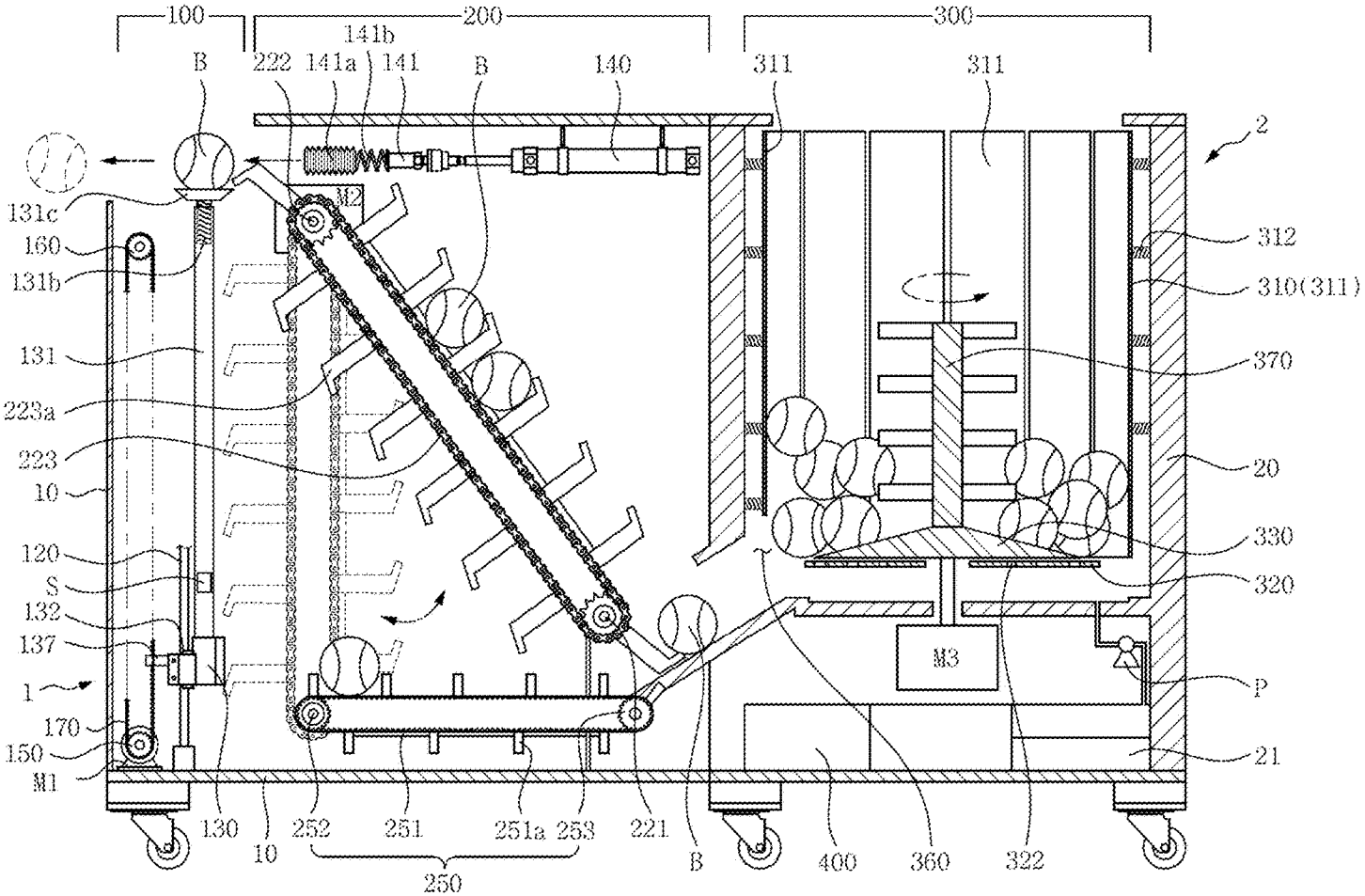
FIG. 5 is a view schematically showing the entire configuration of the automatic batting tee apparatus shown in FIG. 1.
Figure 6:
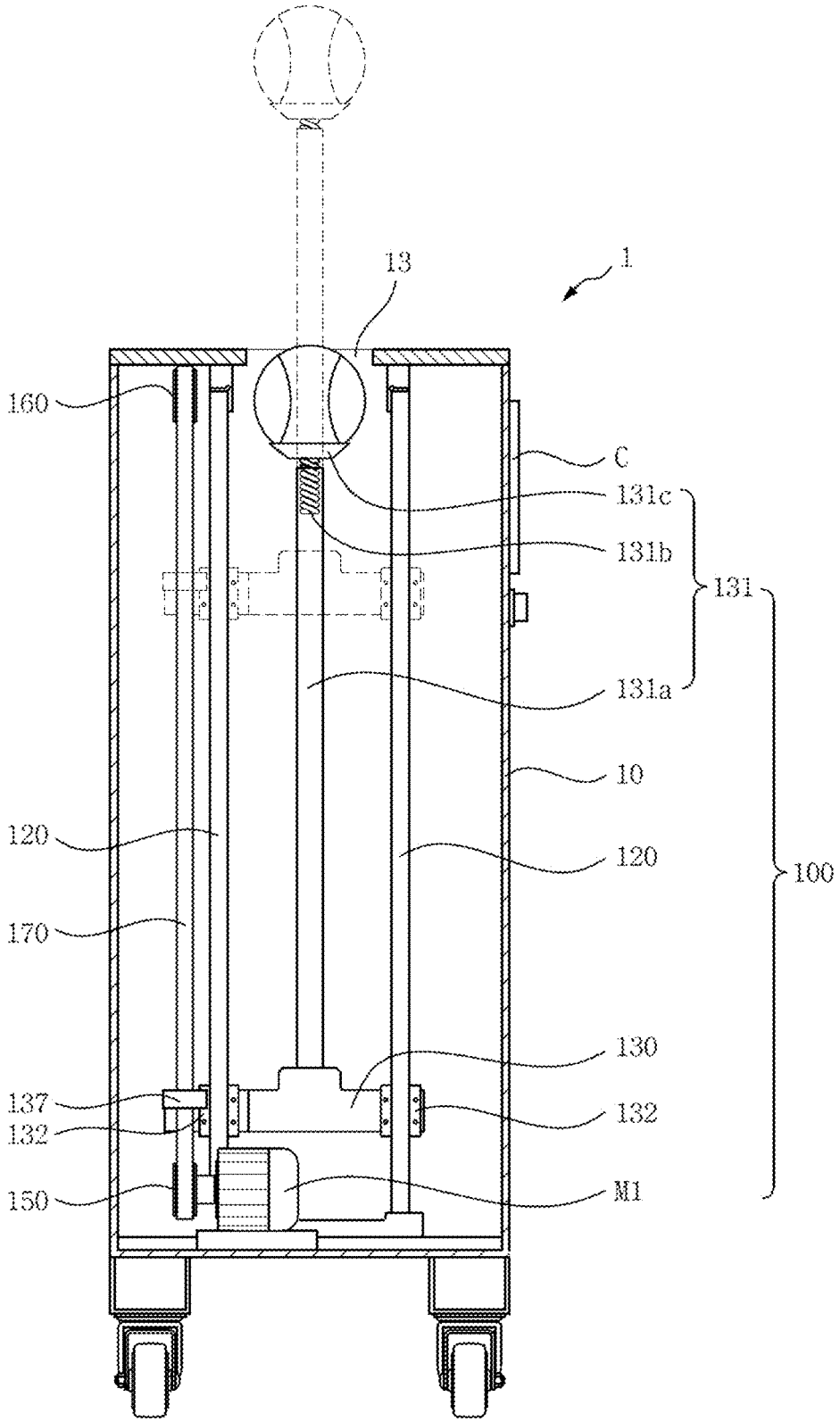
FIG. 6 is a view schematically showing a lifting unit in the automatic batting tee apparatus.

FIGS. 5 and 6 are views schematically showing the internal configuration of the automatic batting tee apparatus.

The lifting unit 100 is a part for putting balls B fed to the feeding unit 200, for example, into a strike zone or another predetermined hitting area for T-batting by adjusting the height of the balls B.

As shown in the figures, the lifting unit 100 can vertically move a tee rod 131 by turning a belt 170 with a motor M1 in a first case 10 defining its internal space. The tee rod 131, as shown in FIG. 6, vertically extends on a carriage 130 and is composed of a support bar 131*a* and a seat 131*c* for a ball at the upper end of the support bar 131*a*. The support bar 131*a* may have a sensor S. The sensor S may be a vibration sensor. When the sensor S senses vibration on the support bar 131*a*, the sensor S sends out a sensing signal to a controller C, and the controller C receiving the signal can move down the tee rod 131 to receive a ball B on the seat 131*c* and then move the tee rod 131 up to a predetermined height.

A spring 131*b* may be disposed in the tee rod 131 between the support bar 131*a* and the seat 131*c*. The spring 131*b* spaces the support bar 131*a* and the seat 131*c* with a predetermined gap, so when a batter hits the support bar 131*a* and/or the seat 131*c* with a bat, it is possible to minimize shock to the batter and prevent damage to the support bar and the seat. After the shock is removed, the support bar 131*a* and the seat 131*c* can be quickly returned by elastic force of the spring 131*b*.

The lifting unit 100 includes a first belt pulley 150 connected to a driving shaft of the motor M1 in the first case 10, a second belt pulley 160 disposed at a predetermined distance over the first belt pulley 150, and a belt 170 wound and turned around the first belt pulley 150 and the second belt pulley 160. As shown in the figure, the first belt pulley 150 is disposed on the bottom inside the first case 10, while the second belt pulley 160 is disposed at an upper portion inside the first case 10.

The lifting unit 100 includes rails 120 vertically extending in the first case 10, in which the rails 120 are a pair of rails arranged in parallel. The carriage 130, which is a part sliding along the rails 120, is fastened to the belt 170 by a clamp 137, so it can vertically move along the rails 120 with turning of the belt 170. That is, the belt 170 and the rail 120 are arranged in parallel, and when the belt 170 is turned, the carriage 130 can control the height for a hitting point, that is, the highest position of the tee rod 131 in accordance with the physical conditions of a batter or a predetermined batting position by vertically moving along the rails.

As shown in the figure, the carriage 130 has holders 132 for coupling to the rail 120. The number of the holders 132 is the same as that of the rails 120 and the holders 132 are integrated with the carriage 130 to prevent separation and help slide of the carriage 130. Alternatively, the holders 132 may have a roller or a bearing to reduce friction on the rails 120.

In other words, the carriage 130 has a clamp 137 on a side. The clamp 137 is provided to couple the carriage to the belt 170 that is turned by the motor M1. Accordingly, the belt 170 is fixed to a side of the carriage 130 by the clamp 137, so the carriage 130 can slide on the rails 120 to correspond to the turning speed and/or the turning distance of the belt 170. That is, the lifting unit 100 of the present invention is designed to be operated in a belt-driving type so that the seat 131*c* of the carriage 130 can be vertically reciprocated.

The first body 1 has an opening 13 at the top of the first case 10 housing the lifting unit 100 and the opening 13 functions as a passage for the support bar 131*a* and/or the seat 131*c* of the tee rod 131 vertically moving. Accordingly, the opening 13 is supposed to be larger than the seat 131*c* or balls B so that the seat 131 can be moved through it.

The opening 13 may extend from the top of the case 10 to the upper end of a side. The opening 13 formed up to the side of the first case 10 may allows a ball B to be projected horizontally by an external force, for example, by the cylinder unit 140. The opening 13 of the first case 10 is formed at the same height as the lowest position of the seat 131*c*, or higher or lower than that. The cylinder unit 140 is disposed horizontally at the same height as the lowest position of the seat 131*c* and has an actuating rod 141 that is horizontally reciprocated by the cylinder unit 140. The free end of the actuating rod 141 forcibly pushes or hits a ball B on the seat 131*c* by applying a force to a side of the ball B to horizontally project the ball B from the opening 13. The flight trajectory, flight speed, and flight distance of the ball B may be controlled in accordance with the magnitude of the force applied by the actuating rod 141. The cylinder unit 140 can allow for catching, fungo, and long tossing by horizontally projecting balls B, as described above. Further, an elastic rubber member 141*a* may be mounted at the free end of the actuating rod 141 and a compression spring 141*b* may be disposed between the free end of the actuating rod 141 and the elastic rubber member 141*a* in order to effectively horizontally project a ball B.

The feeding unit 200 can feed balls B upward from the first case 10 to the seat 131*c* of the tee rod 131, using the motor M2 in the first case 10 defining the internal space. The feeding unit 200 can feed balls B at a lower position to the tee rod 131 at a higher position, so it is possible to generally reduce the height of the automatic batting tee apparatus of the present invention.

In detail, the feeding unit 200 is disposed close to a side facing the opening 13 of the first case 10, a first sprocket 221 is disposed on a shaft at a lower portion in the first case 10, a second sprocket 222 is disposed on a shaft at an upper portion in the first case 10, and a chain 223 is engaged with teeth of the first sprocket 221 and the second sprocket 222 to be turned. When the second sprocket 222 connected to the motor M2 is turned, the chain engaged with the teeth of the second sprocket 222 is turned upward. Further, the feeding unit 200 may be installed to be turned at a predetermined angle about the shaft of the second sprocket 222. The feeding unit 200 installed to be turned, for example, may be vertically erected in the first case 10 when the automatic batting tee apparatus is carried, and may be inclined at a predetermined angle, for example, 45 degrees for batting practice. The installation angle of the feeding unit 200 may be variously set in accordance with requirements of a worker or a batter.

The chain 223 has a plurality of pins 223*a* arranged with regular intervals on the outer side. The pins 223*a* may be arranged with a gap larger than the diameter of balls B so that the balls can be placed between adjacent pins 223*a*. The gap between the pins 223*a* may be 1.1 to 1.5 times the diameter of balls.

Alternatively, the feeding unit 200 may further include a conveyer 250 under the first sprocket 221. The conveyer 250 includes a belt 251 for continuously conveying balls B in one direction and the belt 251 is wound around two wheels 252 and 253 to be turned. The term 'one direction' means the direction in which balls B are feed from the guide 360 of the ball storage unit 300 to the area under the first sprocket 221 in the feeding unit 200.

A plurality of pins 251 are is arranged with regular intervals on the outer side of the belt 251. The pins 251*a* are provided to feed balls B discharged through the guide 360 from the ball storage unit 300 onto the chain 223 of the feeding unit 200 periodically one by one.

In the automatic batting tee apparatus according to an embodiment of the present invention, the ball storage unit 300 is disposed in the second case 20 and the balls B in the internal space 310 of the ball storage unit 300 are fed to the feeding unit 200 in the first case 10 along the guide 360 of the bottom plate 320 by the rotary plate 330 and the rotary bar 370.

As described above, the rotary plate 330 can move the balls B to the guide 360 by rotated by the motor M3 under the bottom plate 320. The balls B, particularly, baseballs are congested close to the sides of the ribs 311 or the guide 360 by the bottleneck phenomenon due to friction on their surfaces, but in this case, it is possible to easily discharge the balls B one by one through the guide 360 by separating the balls B by rotating the rotary plate 330.

In particular, the rotary plate 330 is formed in the shape of a polyprism. The rotary plate 330 may be formed such that the thickness decreases as it goes radially from the center of the shaft of the motor M3, as shown in FIG. 5, so it can prevent balls B from staying and quickly move the balls B outward, that is, toward the ribs 311.

Figure 2:
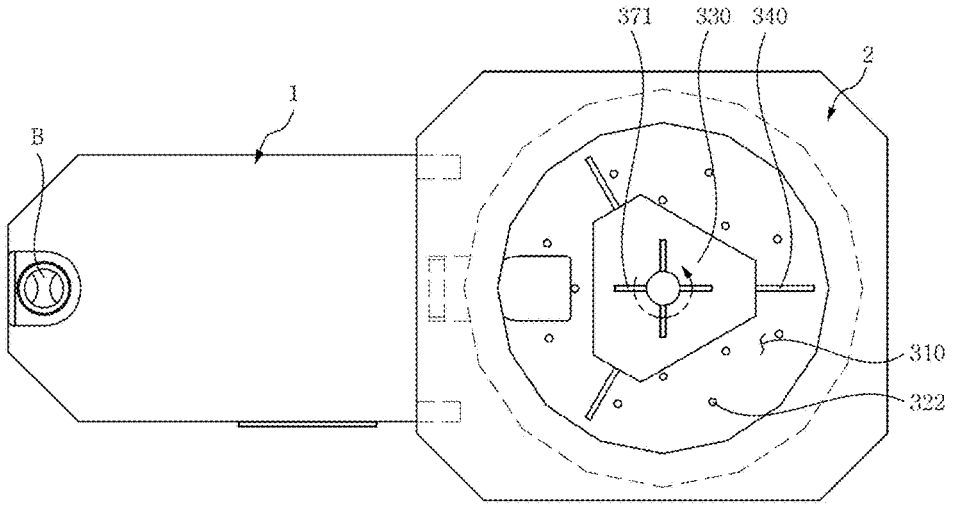
FIG. 2 is a plan view of the automatic batting tee apparatus shown in FIG. 1.

In particular, the bottom of the rotary plate 330 is a polygon, as shown in FIGS. 2 and 3.

In the automatic batting tee apparatus according to an embodiment of the present invention, a vacuum pump P may be additionally provided at a lower portion in the second case 20. The vacuum pump P can suck dirt (soil) dropped off the balls B. To this end, the bottom plate 320 has one or more holes 322 and the holes 322 are supposed to be smaller than the diameter of the ball B. The holes 322 are used as passages for discharging dirt on the bottom plate 320 to the outside of the internal space 310 and the internal space defined by the bottom plate 320 when the vacuum pump P sucks the dirt. The second case 20 can collect dirt sucked by the vacuum pump P into a tray 21. The tray 21 can be detached from the second case 20 to be able to throw dirt and dust collected in the tray 21 to the outside.

Further, the automatic batting tee apparatus according to an embodiment of the present invention includes a storage battery 400 in the first case 10 and/or the second case 20. Since the automatic batting tee apparatus of the present invention includes the storage battery 400, a user can perform batting practice outside even without inserting a plug in an indoor socket.

The automatic batting tee apparatus according to an embodiment of the present invention includes the controller C (see FIG. 1) at the first case 10 and the controller C includes a display to help a user set various items. The controller C can control a sensing signal of the sensor S, the height of the lifting unit 100, the vertical movement speed of the tee rod, operation of the actuating rod 141 of the cylinder unit 140, the feeding speed of the feeding unit 200, rotation of the rotary plate 300, and operation of the vacuum pump P, and it is possible to directly visually check these setting through the display. It is also possible to capture a batting position taken by a specific camera (not shown) and display it or keep it in a specific storage unit (USB and SD card etc.). The captured data may be used later to find out advantages and disadvantage of the batting position.

Figure 7:
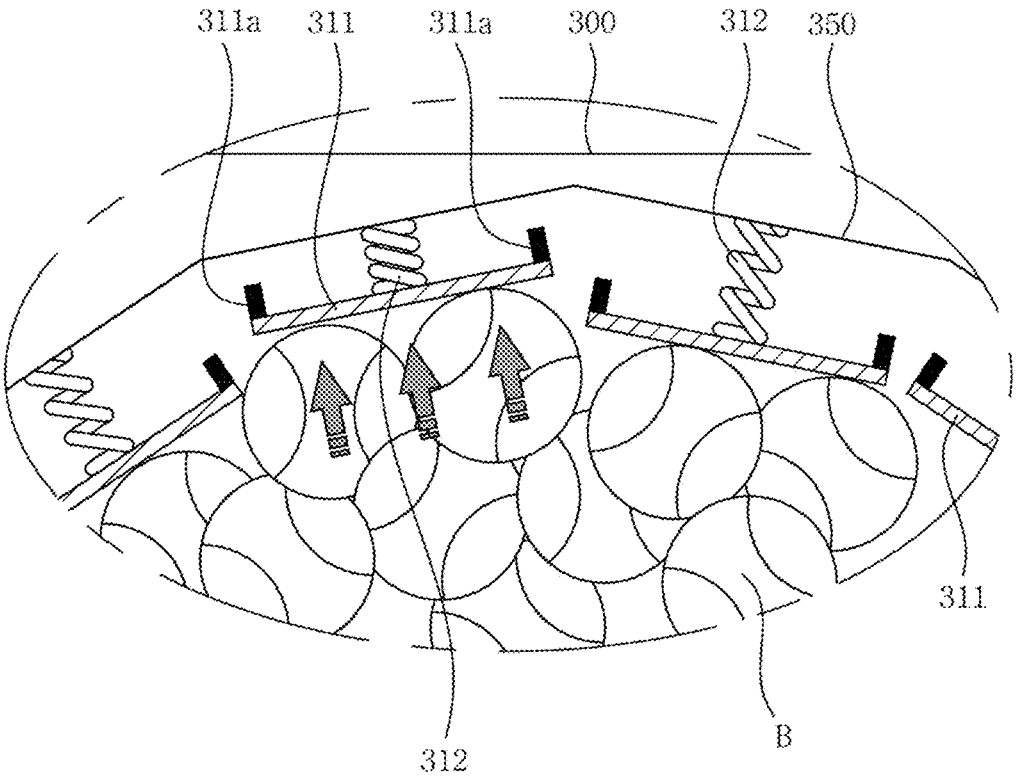
FIG. 7 is a cross-sectional view of the ball storage unit with another example of ribs.

Referring to FIG. 7, the automatic batting tee apparatus according to an embodiment of the present invention may include another type of ribs 311. As described above, the ribs 311 are arranged with predetermined gaps from the inner sides of the tub 350. The ribs 311 can be held on the sides of the tub 350 by the elastic members 312 such that they can radially moved.

The ribs 311 are thin and long plates and may have dampers 311*a* protruding at both sides toward the sides of the tub 350. As a result, the ribs 311 have a U-shape. In particular, the dampers 311*a* adjacent to each other are not in contact with each other, so they can be radially moved.

The elastic members 312 are longer than the dampers 311*a* so that the ribs 311 can be horizontally moved toward the tub 350 when they are pushed by balls B. That is, when the dampers 311*a* of a rib 311 are pressed toward the side, they are moved through the space between the dampers 311*a* of the adjacent ribs 311 at the left and right sides, so left and right inclination of the moving rib 311 can be minimized.

Further, the dampers 311*a* are made of rubber and function as spacers that can absorb shock and limit the movement range of the ribs 311 when the ribs 311 hit the tub 350.

A variable internal space 310 is provided by the ribs 311 that are radially moved when being pressed, so a larger space for the balls B can be achieved.

Although the present invention were described in detail with reference to detailed embodiments, it is provided only for explaining the present invention in detail and the automatic batting tee apparatus is not limited thereto. Further, it is apparent that the present invention may be changed and modified by those skilled in the art without departing from the scope of the present invention.

Simple changes and modifications of the present invention are all included in the scope of the present invention and the detailed protective range of the present invention will be clear from the accompanying claims.

| [Description of the Reference Numerals in the Drawings] | |
|---|---|
| 1: First body | 2: Second body |
| 10: First case | 20: Second case |
| 100: Lifting unit | 200: Feeding unit |
| 300: Ball storage unit | 311: Rib |
| 312: Elastic member | 320: Bottom plate |
| 330: Rotary plate | 350: Tub |
| 370: Rotary bar | |

The invention claimed is:

1. An automatic batting tee apparatus comprising:

a ball storage unit (300) for continuously feeding balls (B) therein for batting;

a lifting unit (100) having a tee rod (131), wherein the balls (B) discharged from the ball storage unit (300) are positioned onto an upper end of the tee rod (131) for T-batting; and a feeding unit (200) disposed between the ball storage unit (300) and the lifting unit (100), wherein the ball storage unit (300) includes:

a hollow container (350);

a bottom plate (320) having one or more holes (322) and a guide (360) extending downward at an edge of the bottom plate, and closing a bottom of the hollow container (350);

a plurality of ribs (311 arranged at a predetermined interval around inner sides of the hollow container (350) and spaced above the bottom plate (320);

elastic members (312) disposed between the hollow container (350) and the plurality of ribs (311);

a rotary plate (330) formed in a pyramid shape with a polygonal bottom and rotatably disposed on the bottom plate (320); and a motor (M3) for operating the rotary plate (330).

2. The apparatus of claim 1, wherein the rotary plate (330) has one or more wings (340) along an edge of the bottom.

3. The apparatus of claim 2, wherein the wings (340) are made from a soft material in a shape of a thin long bar.

4. The apparatus of claim 1, wherein a distance ($L_{330}$) from a center of the rotary plate (330) to the edge of the bottom plate is longer than or the same as a distance (L) from the center of the rotary plate (300) to the guide (330).

5. The apparatus of claim 1, wherein the rotary plate (330) further has a rotary bar (370) coaxially disposed on the rotary plate (330).

6. The apparatus of claim 5, wherein the rotary bar (370) has one or more arms (371) radially protruding outward around the rotary bar (370).

7. The apparatus of claim 1, wherein the ball storage unit (300) further includes a vacuum pump (P) sucking dirt accumulated within the ball storage unit (300) through the one or more holes (322) and a tray (21) collecting dirt sucked by the vacuum pump (P).

8. The apparatus of claim 1, wherein the elastic members (312) are compression springs.

9. The apparatus of claim 1, wherein the tub (350) is formed in a shape of a polyprism.

10. The apparatus of claim 1, wherein the number of the plurality of ribs (311) is equal to the number of the sides of the hollow container (350).

11. The apparatus of claim 1, wherein the plurality of ribs (311) have dampers (311*a*) protruding radially from both sides of the ribs (311).

12. The apparatus of claim 11, wherein the dampers (311*a*) are made of rubber.

13. The apparatus of claim 1, wherein the lifting unit (100) includes:

rails (120) extending vertically upward;

a belt (170) disposed in parallel with the rails (120) and rotated by a motor (M1);

a carriage (130) sliding on the rails (120) when the belt (170) is rotated; and the tee rod (131) vertically disposed on the carriage (130).

14. The apparatus of claim 13, wherein the tee rod (131) includes:

a support bar (131*a*) extending longitudinally;

a seat (131*c*) disposed at an upper end of the support bar (131*a*) to receive the balls (B);

a spring (131*b*) disposed between the upper end of the support bar (131*a*) and the seat (131*c*); and a sensor (S) positioned on the support bar (131*a*).

15. The apparatus of claim 1, wherein the feeding unit (200) includes two wheels (252 and 253) spaced from each other, a belt (251) wound around the two wheels (252 and 253) to be turned, and a plurality of pins (251*a*) arranged at regular intervals on an outer side of the belt (251).

16. The apparatus of claim 14, further comprising a cylinder unit (140).

17. The apparatus of claim 16, wherein the cylinder unit (140) is disposed at the same height as a lowest position of the seat (131*c*) of the tee rod (131).

* * * * *